US006390546B1

(12) United States Patent
Ming

(10) Patent No.: US 6,390,546 B1
(45) Date of Patent: May 21, 2002

(54) MASSAGING CHAIR

(76) Inventor: Liao Tsung Ming, 2-8 North South One Road, Tah Cha Township, Taichung Hsien (TW)

( * ) Notice: Subject to any disclaimer, the term of this patent is extended or adjusted under 35 U.S.C. 154(b) by 0 days.

(21) Appl. No.: 09/611,070

(22) Filed: Jul. 6, 2000

(51) Int. Cl.[7] ..... A47C 1/02
(52) U.S. Cl. ..... 297/68; 297/423.19
(58) Field of Search ..... 297/68, 69, 71, 297/75, 88, 288, 362.13, 423.1, 423.12, 423.19, 423.2, 423.23, 423.26

(56) References Cited

U.S. PATENT DOCUMENTS 3,858,938 A * 1/1975 Kristensson et al. ... 297/423.19
5,082,324 A * 1/1992 Harada et al. ..... 397/68 X
5,342,112 A * 8/1994 Padovan ..... 297/423.26 X
5,857,739 A * 1/1999 Smith ..... 297/88
5,868,461 A * 2/1999 Brotherson ..... 297/362.13 X
6,227,489 B1 * 5/2001 Kitamoto et al. ..... 297/68 X

* cited by examiner

*Primary Examiner*—Peter M. Cuomo
*Assistant Examiner*—Stephen Vu
(74) *Attorney, Agent, or Firm*—Harrison & Egbert

(57) ABSTRACT

A massaging chair has a backrest, a seat, two armrests, and a hassock. The backrest is provided with a first cross rod, whereas the hassock is provided with a second cross rod which is connected with the first cross rod of the backrest by a connection rod in conjunction with an air pressure cylinder. As the backrest is reclined, the hassock is raised. Both the backrest and the hassock can be adjusted to be horizontal in relation to the seat.

1 Claim, 6 Drawing Sheets

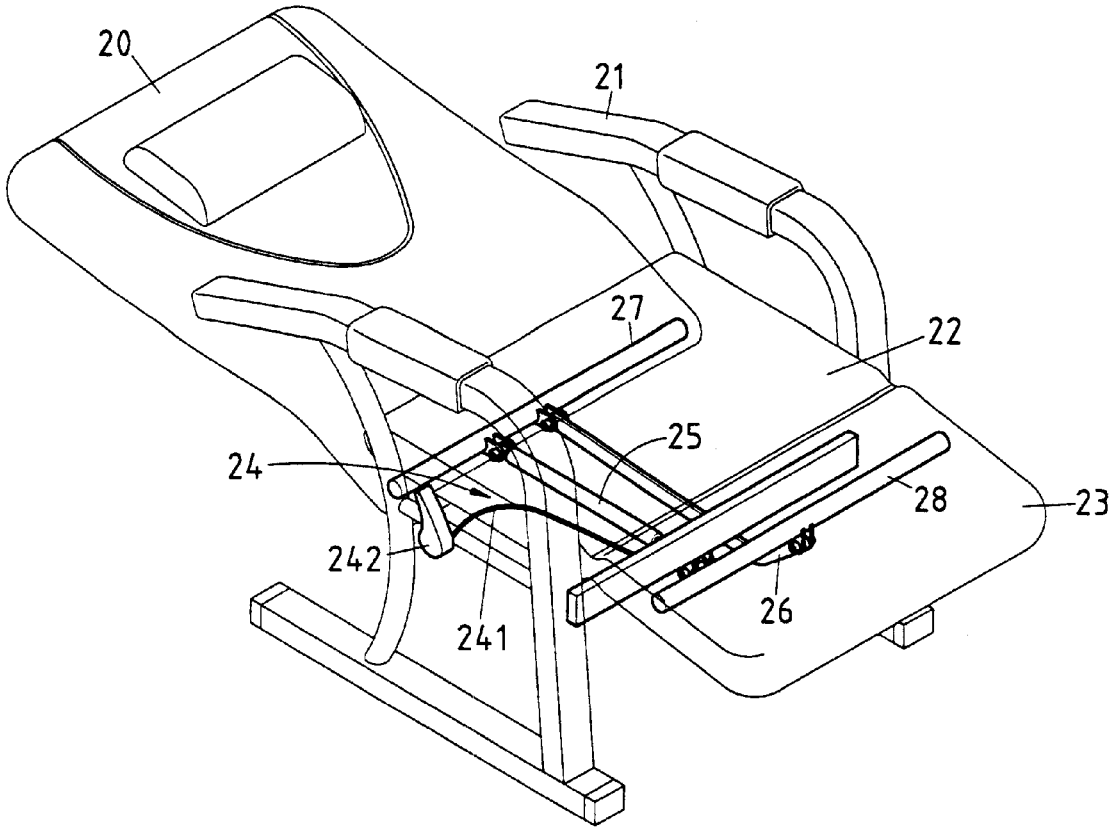
FIG.3-A

MASSAGING CHAIR

BACKGROUND OF THE INVENTION

1. Field of the Invention

The present invention relates generally to a massaging device, and more particularly to a massaging chair.

2. Description of Related Art

As shown in FIGS. 1 and 2, a massaging chair of the prior art comprises a seat frame 10, a backrest frame 11, a power drive device 12, a legrest frame 13, and a link device comprising a connection rod 16 pivoted to the bottom of the seat frame 10 and provided with a moving rod 17, a drive rod set 14, and a driven rod set 15. When the backrest frame 11 is driven by the power drive device 12 to recline, the action rod 141 of the drive rod set 14 is actuated by the backrest frame 11 to act with the link rod 142, thereby causing the action rod 141 to push a wheel member 153 located in a receiving slot 152 of the acting rod 151. As a result, the urging rod 154 of the driven rod set 151 to act with the acting rod 151 so as to raise the legrest frame 13.

Such a massaging chair of the prior art described above is defective in design in that it is rather complicated in construction, and that it can not be easily assembled, and further that it is not cost-effective.

SUMMARY OF THE INVENTION

It is therefore the primary objective of the present invention to provide a massaging chair which is simple in construction.

It is another objective of the present invention to provide a massaging chair which is cost-effective.

It is still another objective of the present invention to provide a massaging chair with an air pressure cylinder for preventing the backrest of the massaging chair from reclining abruptly.

It is still another objective of the present invention to provide a massaging chair with means to enable the backrest of the massaging chair to be located horizontally.

The foregoing objectives and features of the present invention will be more readily understood upon a thoughtful deliberation of the following detailed description of a preferred embodiment of the present invention with reference to the accompanying drawings.

BRIEF DESCRIPTION OF THE SEVERAL VIEWS OF THE DRAWINGS

FIG. 3-A is a perspective view of the present invention showing the seat and seat back as secured to the frame.

DETAILED DESCRIPTION OF THE INVENTION

Figure 1:
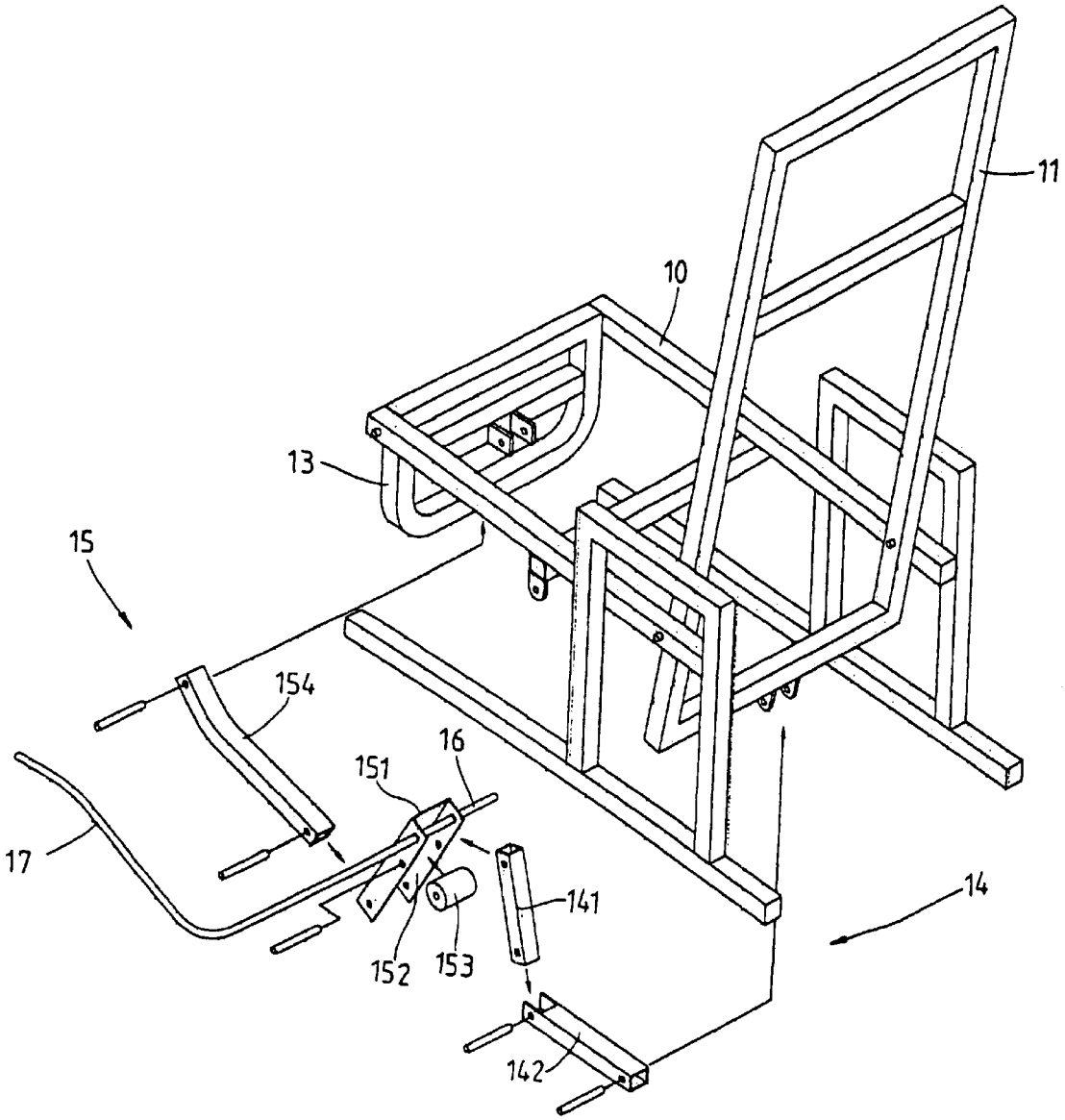
FIG.1 PRIOR ART
FIG. 1 shows a partial exploded view of a massaging chair of the prior art.
Figure 2:
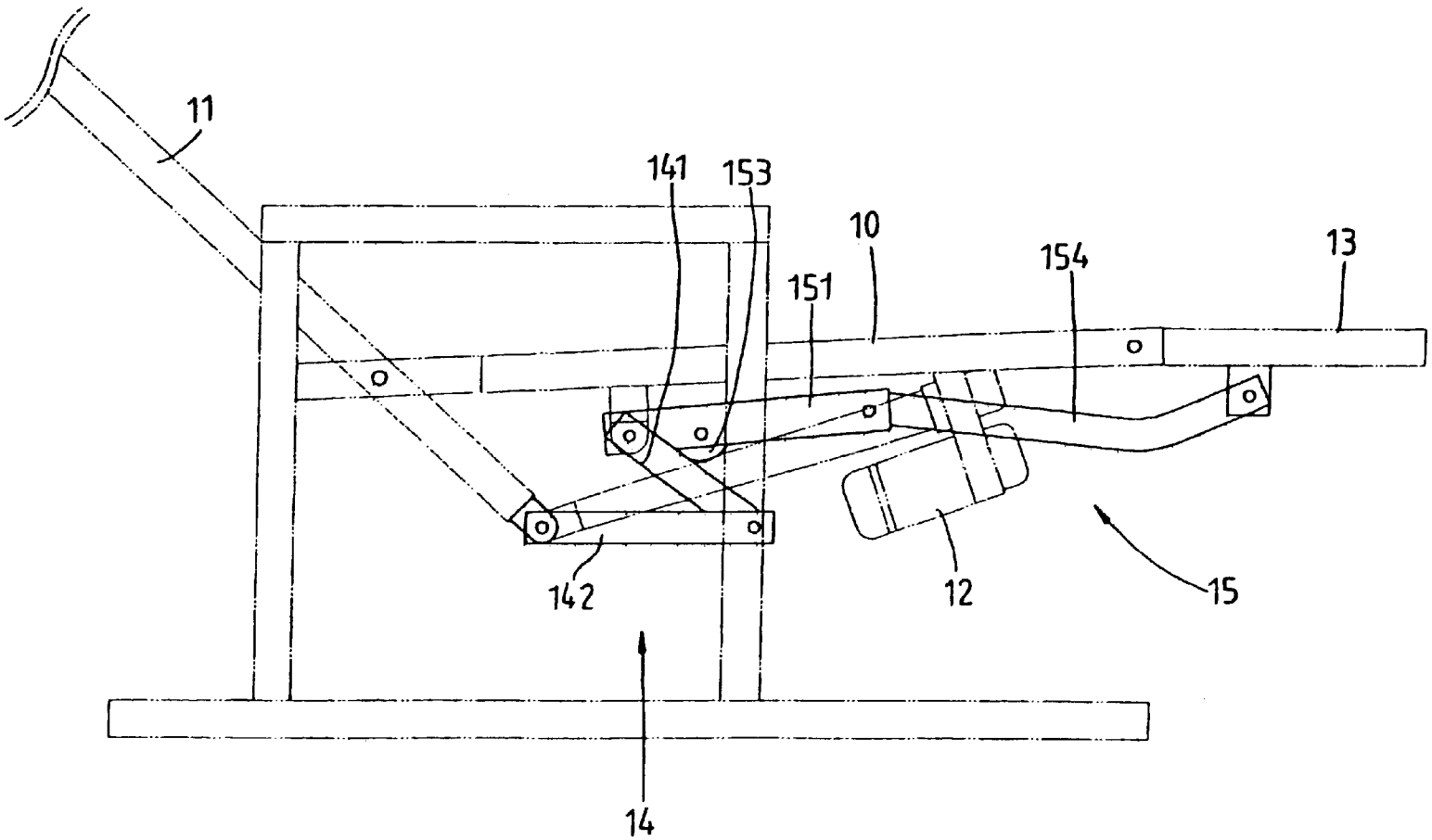
FIG.2 PRIOR ART
FIG. 2 shows a side schematic view of the prior art massaging chair.
Figure 3:
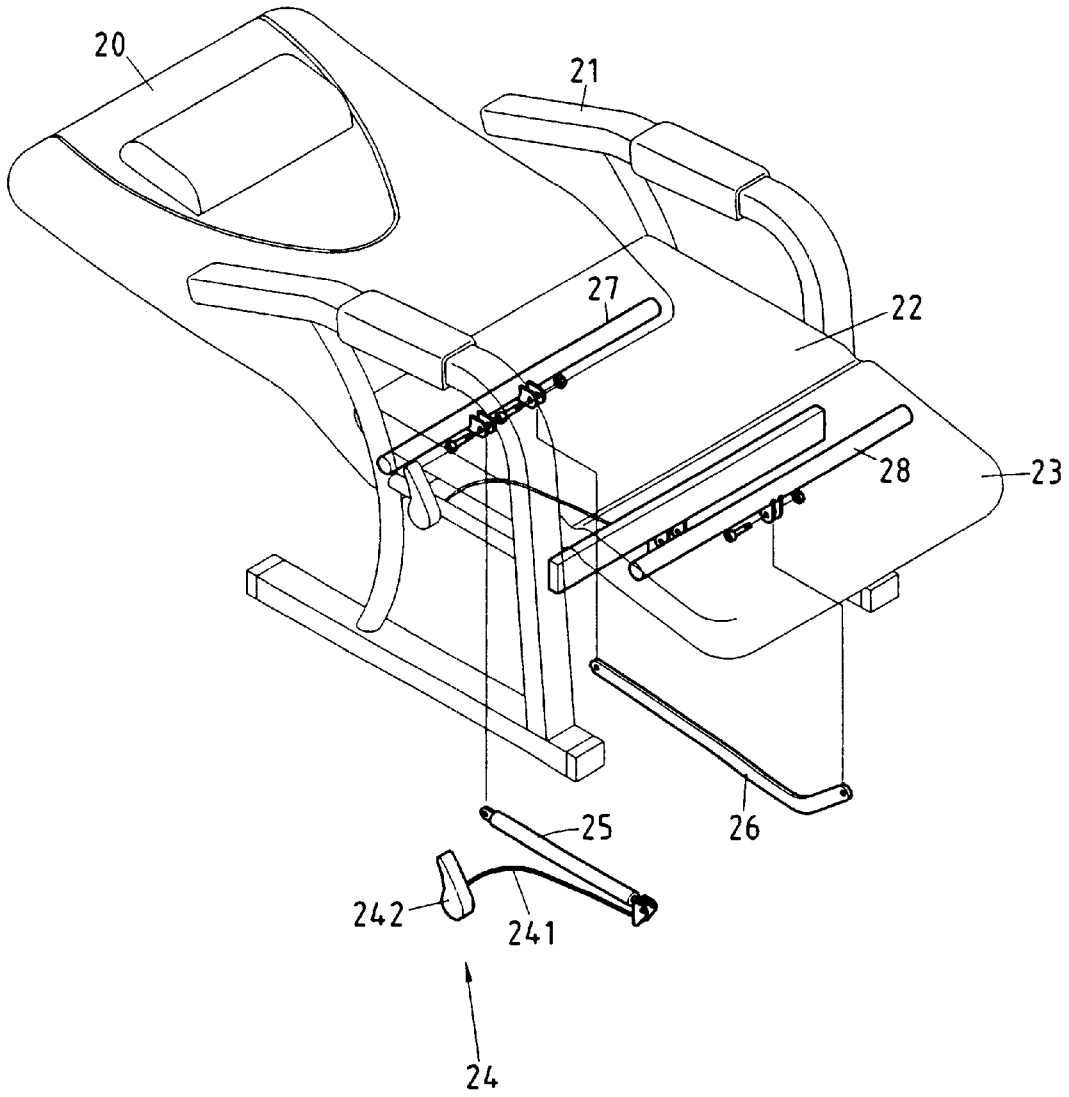
FIG. 3 shows a partial exploded view of the preferred embodiment of the present invention.
Figure 4:
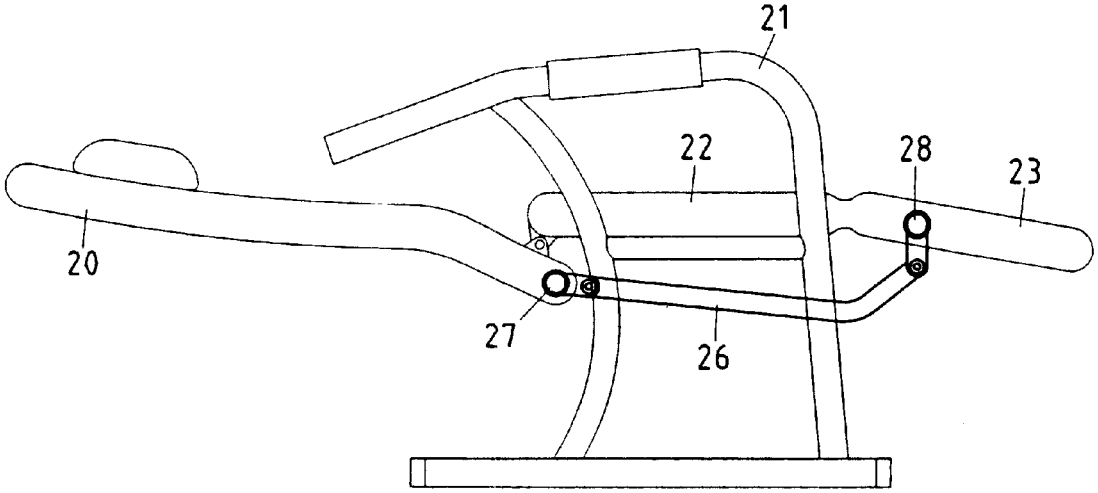
FIG. 4 shows a side schematic view of the preferred embodiment of the present invention.
Figure 5:
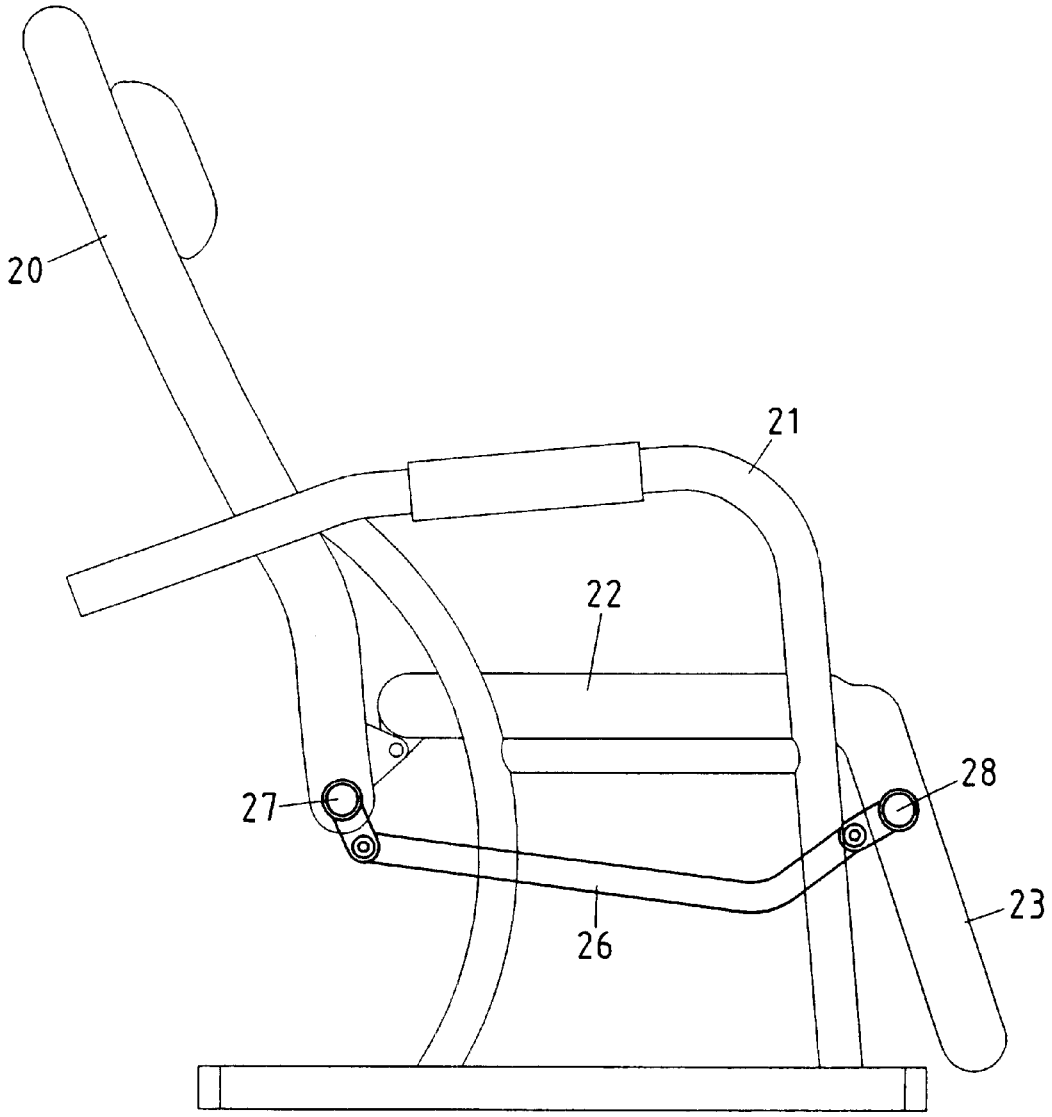
FIG. 5 shows another side schematic view of the preferred embodiment of the present invention.

As shown in FIGS. 3–5, a massaging chair of the preferred embodiment of the present comprises a backrest 20, two armrests 21, a seat 22, and a hassock 23.

The massaging chair of the present invention is characterized by an air pressure cylinder 25, which is pivoted under the seat 22 and the backrest 20 and is provided with a pressure releasing member 24. The pressure releasing member 24 is provided with a cable 241 which is connected at one en,i with the air pressure cylinder 25 and at the other end with a hand knob 242. The massaging chair of the present invention is further characterized by a connection rod 26 which is pivoted under the hassock 23 and the backrest 20 such that the connection rod 26 is fastened at one end thereof to a first cross rod 27 disposed under the backrest 20, and at the other end thereof to a second cross rod 28 disposed under the hassock 23.

The cable 241 is actuated by the hand knob 242 to cause the backrest 20 to recline gradually. In the meantime, the hassock 23 is raised as the backrest 20 is reclined, because of the connection rod 26 which is provided with a curved end 261 pivoted to the second cross rod 28. In light of the curved end 261 of the connection rod 26 being fastened pivotally to the second cross rod 28, the hassock 23 is raised to locate horizontally in relation to the seat 22 at the time when the backrest 20 is reclined to locate horizontally in relation to the seat 22. In other words, the simultaneous motions of the backrest 20 and the hassock 23 of thee present invention are attained simply by the air pressure cylinder 25 and the connection rod 26.

I claim:

1. A massaging chair comprising:

a reclining backrest having a first cross rod;

a seat pivotally connected to said backrest, said first cross rod positioned to below the pivotal connection of said seat to said backrest;

a pair of armrests positioned respectively on opposite sides of said seat;

a movable hassock connected to an end of said seat opposite said backrest, said hassock having a second cross rod;

a connection rod having a first end connected to said first cross rod and a second end connected to said second cross, rod, said connection rod having a curved end fastened pivotally to said second cross rod; and an air pressure cylinder means having one end connected to said first cross bar, said air pressure means for pulling on said first cross bar so as to move said backrest toward a generally horizontal orientation such that said curved end of said connection rod acts on said second cross bar so as to simultaneously move said hassock upwardly toward a horizontal orientation.

* * * * *